US006756945B2

(12) United States Patent
Mizutani

(10) Patent No.: US 6,756,945 B2
(45) Date of Patent: Jun. 29, 2004

(54) ANTENNA STRUCTURE FOR VEHICLE

(75) Inventor: Kansei Mizutani, Nisshin (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/265,687

(22) Filed: Oct. 8, 2002

(65) Prior Publication Data

US 2003/0080908 A1 May 1, 2003

(30) Foreign Application Priority Data

Oct. 30, 2001 (JP) ..... 2001-333065

(51) Int. Cl.[7] ..... H01Q 1/32
(52) U.S. Cl. ..... 343/713; 343/767
(58) Field of Search ..... 343/711, 712, 343/713, 767, 770

(56) References Cited

U.S. PATENT DOCUMENTS 4,721,963 A * 1/1988 Nagy et al. ..... 343/712
4,737,795 A * 4/1988 Nagy et al. ..... 343/712
4,769,655 A * 9/1988 Nagy et al. ..... 343/712
4,821,040 A * 4/1989 Johnson et al. ..... 343/700 MS
5,402,134 A * 3/1995 Miller et al. ..... 343/742
2002/0175868 A1 * 11/2002 Reichert ..... 343/713

FOREIGN PATENT DOCUMENTS

| | | |
|---|---|---|
| JP | U 2-30611 | 2/1990 |
| JP | U 2-32215 | 2/1990 |
| JP | U 2-123108 | 10/1990 |
| JP | A 4-275705 | 10/1992 |
| JP | A 6-152219 | 5/1994 |

* cited by examiner

*Primary Examiner*—Tan Ho
(74) *Attorney, Agent, or Firm*—Oliff & Berridge, PLC

(57) ABSTRACT

An antenna structure for a vehicle includes a vehicle body component member of which at least a part is made of an insulating material. A conductive film is provided closer to the inside of the vehicle than the vehicle body component member, and a slot is formed on a part of the conductive film that constitutes an antenna.

6 Claims, 3 Drawing Sheets

ANTENNA STRUCTURE FOR VEHICLE

INCORPORATION BY REFERENCE

The disclosure of Japanese Patent Application No. 2001-333065 filed on Oct. 30, 2001 including the specification, drawings and abstract is incorporated herein by reference in its entirety.

BACKGROUND OF THE INVENTION

1. Field of Invention

The invention relates to an antenna structure, and more particularly to an antenna structure for a vehicle which is suitable when a vehicle component member such as a roof panel and the like is made of an insulating material.

2. Description of Related Art

A roof portion of a vehicle, for example, is generally made of a metallic material, such as a steel sheet and the like. However, in recent years, for the purpose of weight reduction, and improvement of design, assembly workability and the like, of the vehicle, a proposal that the roof portion be made of a resin material and the like having a predetermined strength has been suggested.

For example Japanese Utility Laid-Open Publication No. 2-123108, discloses a cloth including metal fibers which has a radio wave reflecting or absorbing effect is provided as an interior trim inside the passenger compartment such that the gain of the antenna provided on the roof side is increased.

However, if the resin roof is adopted, there arises a problem that an electrical noise generated by an electrical component, such as an ECU (electronic control unit) and the like, provided in the vehicle tends to leak outside.

As mentioned above, a metallic roof panel is generally used in the vehicle, and this metallic roof has a noise insulating effect. The metallic roof panel is structured so as to suppress the electrical noise generated in the vehicle from being emitted outside.

However, using the resin roof reduces the aforementioned noise insulating effect that was achieved by the vehicle body structure itself, thereby causing a problem that the noise leaks outside.

Although, a number of proposals have been made with respect to obtaining an antenna structure with favorable characteristics in relation to making the roof portion of resin, no proposals have been made with respect to the antenna structure for the vehicle which takes into account the problem of noise leak caused by making the roof portion of resin.

SUMMARY OF THE INVENTION

It is an object of the invention to provide an antenna structure for a vehicle which takes into account the suppression of noise leak caused when a vehicle component member is made of an insulating material such as resin and the like.

It is another object of the invention to provide an antenna structure for a vehicle which also takes into account the suppression of leak of a noise generated in the vehicle.

In order to achieve the aforementioned objects, an antenna structure for a vehicle, according to a first exemplary embodiment of the invention, includes a vehicle body component member of which at least a part is made of an insulating material, a conductive film provided inside or on a surface of the insulating material, and a slot which is formed on a part of the conductive film to constitute an antenna.

According to the first exemplary embodiment of the invention, a portion of the conductive film on which the slot is formed serves as a so-called slot antenna. In addition, the conductive film functions the same as the conventional metallic roof panel, thereby blocking off the noise effectively. Accordingly, an antenna structure capable of receiving a desired radio wave while suppressing noise leak outside the vehicle can be provided. Furthermore, since the conductive film serves as the slot antenna and a noise insulating member, the number of component parts can be reduced making it possible to provide the antenna structure at low cost.

In an exemplary embodiment of the invention, a roof portion in the upper part of the vehicle is provided as a suitable example of the vehicle body component member. However, the antenna structure according to the invention can also be applied to various component members constituting a vehicle outer face, such as a luggage compartment, a fender, a door and the like, any of which is made of resin.

Further, an antenna structure for a vehicle according to a second exemplary embodiment of the invention includes a vehicle body component member of which at least a part is made of an insulating material, a conductive film provided at a certain distance from the insulating material, and a slot which is formed on a part of the conductive film to constitute an antenna.

The conductive film need not necessarily be provided in contact with the insulating material, and may be provided at a certain distance from the insulating material as in the second exemplary embodiment of the invention.

Also, according to the second exemplary embodiment of the invention, a portion of the conductive film on which the slot is formed serves as the slot antenna. In addition, the conductive film functions as the conventional metallic roof panel, thereby blocking off the noise. Accordingly, a desired radio wave can be received while suppressing noise leak outside the vehicle.

Further, in the first and second exemplary embodiments of the invention, the conductive film may be structured to be grounded on a conductive portion of the vehicle body.

According to this structure, since the conductive film is grounded on the vehicle body, the same insulation effect as that obtained with the conventional metallic roof panel can be expected.

In addition, in the second exemplary embodiment described above, the conductive film may be structured to be integrally formed with an interior trim member inside the passenger compartment.

Where the conductive film is provided at a certain distance from the insulating material, the conductive film is integrated with the interior trim member provided inside the passenger compartment, and therefore there is no need to provide a new member which is required when arranging the conductive film. Therefore, the same assembly workability as that with the conventional structure can be assured, and a preferable antenna structure can be provided in the vehicle without increasing the number of component parts.

DETAILED DESCRIPTION OF PREFERRED EMBODIMENTS

Hereinafter, an antenna structure according to the exemplary embodiments of the invention will be described with reference to the accompanying drawings.

Figure 1:
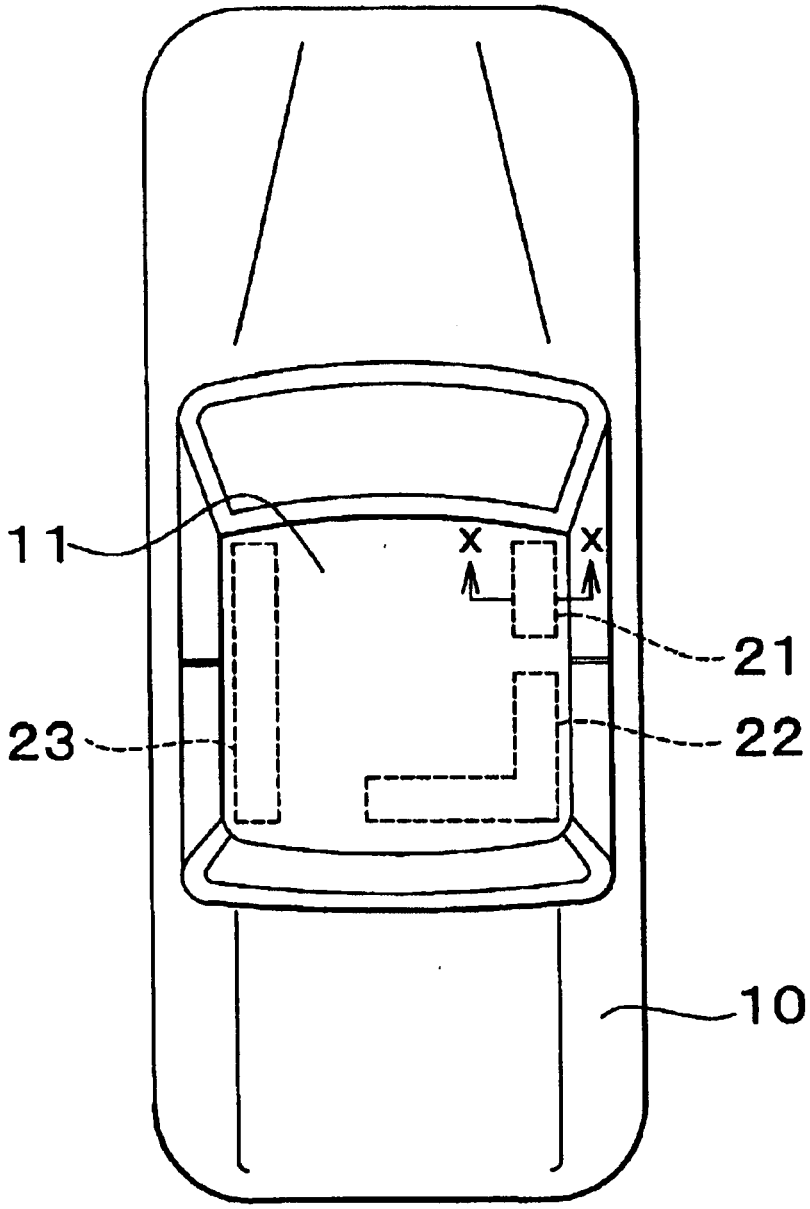
FIG. 1 is a view showing a vehicle provided with an antenna structure for a vehicle according to a first exemplary embodiment.

FIG. 1 shows a vehicle provided with an antenna structure for a vehicle according to a first exemplary embodiment. In the first exemplary embodiment a roof portion of a vehicle 10 is made of an insulating material. A resin material, for example, can be suitably used as the insulating material, and also a wide variety of conventional materials used in general such as a thermoplastic resin, a thermosetting resin, a reactive resin and the like may also be adopted. The roof portion may be made of resin entirely or partially according to the design of the vehicle 10. In this exemplary embodiment, almost all of the area of the roof portion is made of resin. The resin roof portion is hereinafter referred to as a resin roof 11.

A conductive film (not shown in FIG. 1) is disposed in contact with the bottom surface of the resin roof 11. A slot corresponding to a wavelength to be received is formed on the conductive film. For example, a slot corresponding to a wavelength of each types of media such as radio, television, telephone, CPS, ETC, and the like may be formed on the conductive film. In FIG. 1, slots 21, 22, 23 formed on the conductive film are shown as examples. The slots 21, 22, 23 are illustrated in an exaggerated way. In practice, a width of each slot is approximately few millimeters. A length of each slot is set appropriately with reference to the wavelength to be received.

Further, by providing the conductive film in correspondence to the position of the resin roof 11, an electrical noise generated in the vehicle is suppressed from being leaked outside, as in the case where the conventional metallic roof panel is used. In addition, the conductive film is made to serve as a slot antenna by being provided with the slots 21, 22, 23 thereon. That is, one conductive film is used both as a noise insulating member and an antenna for receiving radio wave.

Figure 2:
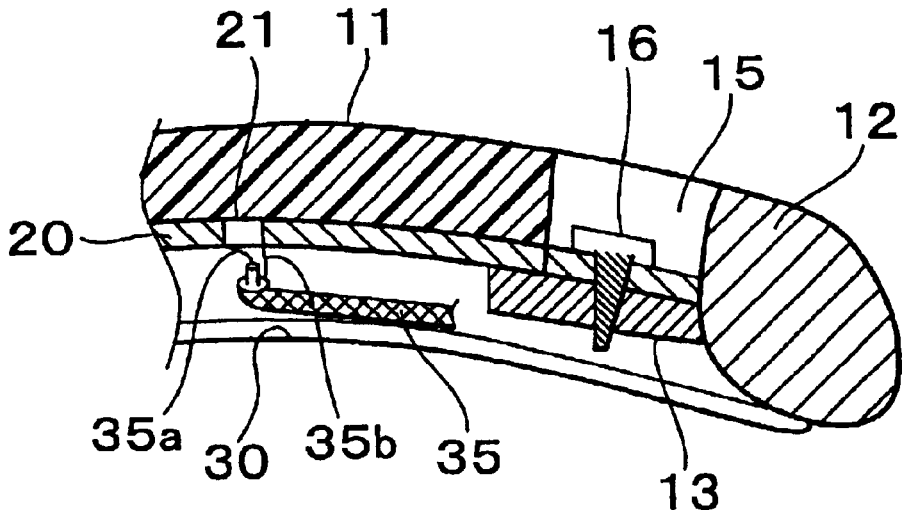
FIG. 2 is a view showing a sectional structure of the antenna structure for a vehicle taken along line X—X in FIG. 1.

Referring to FIG. 2, the antenna structure for the vehicle 10 according to the first exemplary embodiment is further described in detail. FIG. 2 shows a sectional structure of the roof portion of the vehicle 10 taken along the line X—X in FIG. 1. FIG. 2 also illustrates the conductive film mentioned above.

In FIG. 2, a body frame 12 is disposed on an outer peripheral portion of the roof. The body frame 12 is provided with a roof reinforcement member 13 for supporting and reinforcing the resin roof 11. The body frame 12 and the roof reinforcement member 13 are made of a conductive metallic material such as a steel sheet, and are integrally formed or connected with each other by welding, or the like.

The conductive film 20 is attached to the bottom surface of the resin roof 11. The conductive film 20 can be formed, for example, by using a conductive material such as a thin metallic film, a resin film on which metal is deposited, or a conductive film in which metal powder and the like is mixed. The conductive film 20 may be attached to the resin roof 11 in advance in order to facilitate assembly of the resin roof 11 during the assembly process.

An end portion of the resin roof 11 is supported on the roof reinforcement 13. The conductive film 20 under the resin roof 11 further extends outward beyond the resin roof 11, and is fixed to the roof reinforcement member 13 by screwing a bolt 16 through the conductive film 20 into the roof reinforcement member 13. Therefore, the conductive film 20 is connected with a metallic portion (conductive portion) of the vehicle by the bolt 16. Other appropriate fasteners, or means of fixing may also be used to secure the conductive film 20 to the roof reinforcement member 13.

A roof side moulding 15 for exterior decoration is fitted between the body frame 12 and the resin roof 11 such that the roof moulding 15 covers the bolt 16.

Further, the conductive film 20 is provided with the slot 21 which constitutes a slot antenna. A generally middle portion of the slot 21 in a longitudinal direction (a direction vertical to the sheet of FIG. 2) serves as a feeding point. A core wire conductor 35*a* of a coaxial cable 35 for supplying electricity is connected to a feeding point on one side in the middle of the slot 21, and an outer sheath conductor 35*b* of the coaxial cable 35 is connected to a feeding point on the opposite side. A signal received via the coaxial cable 35 is supplied to a receiver side of a radio and the like (not shown). Further, the coaxial cable 35 is routed on a roof liner 30 installed in the upper part of the passenger compartment, thereby not creating an eyesore for an occupant of the passenger compartment.

According to the antenna structure for the vehicle in the first exemplary embodiment as described above, because the conductive film 20 is connected with the roof reinforcement member 13 (conductive portion of the vehicle body) by the bolt 16, a noise insulating function, as in the case with the conventional metallic roof panel, can be achieved. As a result, even when the roof portion is made of resin, the noise generated by an ECU or the like, in the vehicle can be suppressed from being leaked outside.

Consequently, the antenna structure for the vehicle according to the first exemplary embodiment is provided with a noise leak suppression function.

In FIG. 2, the structure around the slot 21 shown in FIG. 1 is illustrated, but the same structure is applicable to other slots 22,23 as well. The slot may also be formed in an L-shape, annular shape, swirl shape, or the like.

To prevent noise leak, the conductive film 20 may be disposed over substantially the same area of the resin roof 11. However, an antenna structure having a noise leak suppression function can also be achieved if the conductive film 20 has at least an area in which the slot can be formed, and is connected to the conductive portion of the vehicle body. Accordingly, the antenna structure may be such that a plurality of the conductive films 20 connected to any conductive portion of the vehicle body are arranged on the roof portion independently from each other, and a predetermined slot is formed on each conductive film 20.

FIGS. 1 and 2 show the conductive film 20 connected with the roof reinforcement 13 provided on the peripheral portion of the roof. In addition, if the roof reinforcement member 13 is arranged widthwise of the vehicle in the middle of the roof in a longitudinal direction of the vehicle, the conductive film 20 may be connected with the roof reinforcement (conductive portion of the vehicle body) at the middle portion of the resin roof 11.

Figure 3:
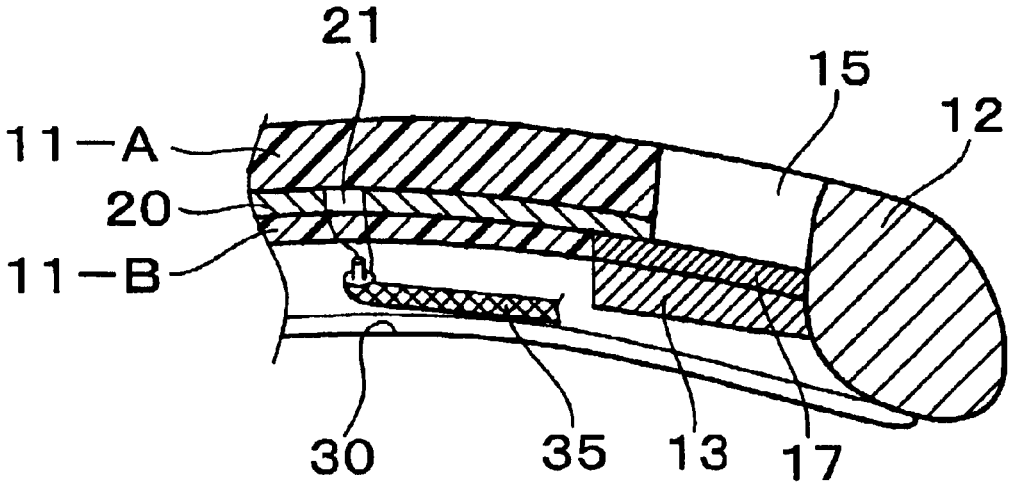
FIG. 3 is a view showing the antenna structure for a vehicle according to a second exemplary embodiment.

FIG. 3 is a view which illustrates an antenna structure for a vehicle according to a second exemplary embodiment.

FIG. 3 shows a sectional structure of the roof portion similar to that of FIG. 2. In this exemplary embodiment, the same reference characters are used to refer to the same portions as in the structure according to the first embodiment, thereby eliminating redundant descriptions.

In the second exemplary embodiment, a sandwich structure is adopted in which the resin roof 11 is divided into two parts 11-A and 11-B between which the conductive film 20 is sandwiched. Such a sandwich-structured resin roof 11 incorporating the conductive film 20 has good formability, thereby maintaining the conventional workability of assembling the resin roof in the upper part of the vehicle.

According to the second exemplary embodiment, the conductive film 20 is welded, or otherwise fixed to a metal plate 17 provided on the roof reinforcement member 13. Thus, the same structure as in the first exemplary embodiment is obtained.

Also in the second exemplary embodiment, the conductive film 20 provided in the middle of the sandwich structure may be extended outward therefrom, and secured to the roof reinforcement 13 by a conductive bolt or other conductive fixing means.

Figure 4:
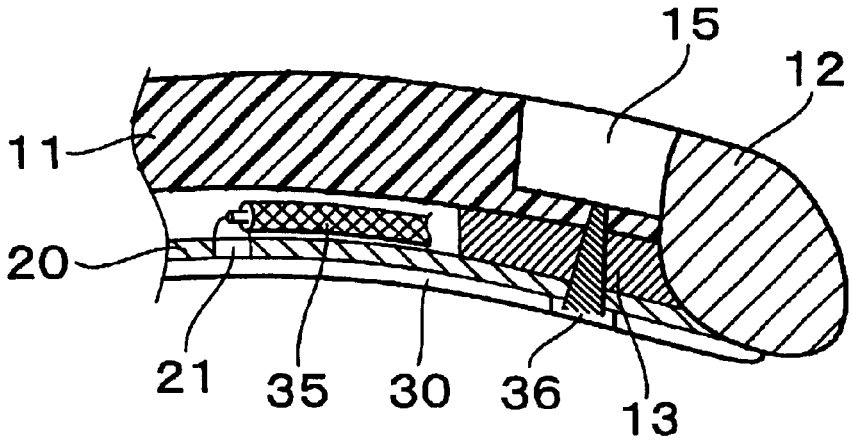
FIG. 4 is a view showing the antenna structure for a vehicle according to a third exemplary embodiment.

FIG. 4 shows an antenna structure for a vehicle according to a third exemplary embodiment. FIG. 4 shows a sectional structure of the roof portion similar to that shown in FIG. 2. In this exemplary embodiment, the same reference characters are also used to refer to the same portions as in the structure according to the first exemplary embodiment, thereby eliminating redundant descriptions.

In the third exemplary embodiment the conductive film 20 is attached onto a roof liner 30 installed in a upper part of the vehicle. In this exemplary embodiment, the conductive film 20 is disposed at a distance from the resin roof 11. However, the same effect as that obtained in the first exemplary embodiment is achieved.

In this exemplary embodiment, the conductive film 20 and the roof liner 30 are secured to the roof reinforcement member 13 by a conductive bolt 36 from inside the passenger compartment. The bolt 36 allows electrical conduction between the conductive film 20 and the roof reinforcement 13. Although a conductive bolt is provided in the exemplary embodiments, other means of conductively fixing the conductive film 20 to the roof reinforcement member 13 are contemplated by this invention.

According to this exemplary embodiment, by attaching in advance the conductive film 20 onto the roof liner 30, which is the interior trim member so as to make them one piece, the conventional assembly workability can be maintained without increasing the number of the component parts.

Figure 5:
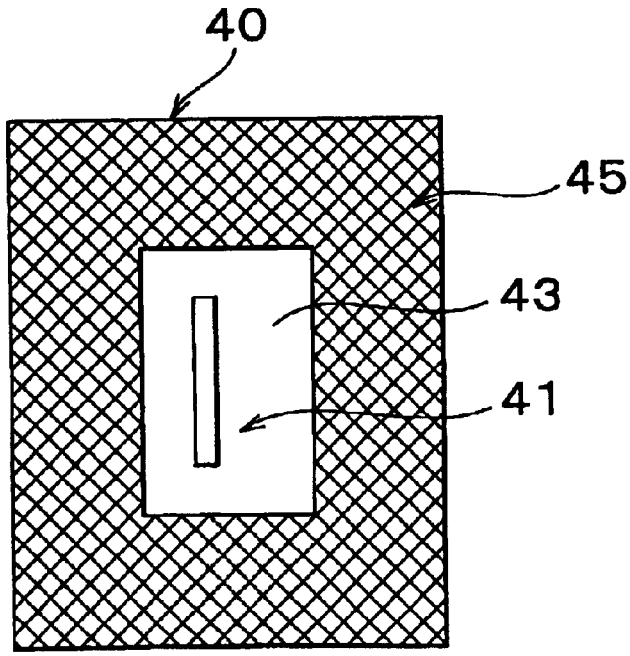
FIG. 5 is a view showing an example of structure of a conductive film which can be applied to the antenna structure for a vehicle according to the exemplary embodiments.

Furthermore, FIG. 5 shows an example of a structure of a conductive film which can be applied to the antenna structure for a vehicle according to the aforementioned exemplary embodiments.

As shown in FIG. 5, a conductive film 40 is made of a conductive metal mesh 45, except for a slot antenna portion 43 which has a slot 41 formed thereon and is made of a tabular or membranous sheet metal or conductive material. The slot antenna portion 43 and the metal mesh 45 are electrically connected with each other. The size of each hole of the metal mesh 45 may be set to about one-fourth of the wavelength of each media or noise to be received.

A similar effect may be obtained when the conductive film 40 is adopted in the antenna structure for a vehicle 10 shown in FIGS. 2 to 4.

In each of the third exemplary embodiments described above, the roof panel is made of resin. However, it is also contemplated that the invention can be applied to other members constituting the vehicle body, such as a luggage compartment, fender, door or the like, made of resin.

Although the exemplary embodiments of the invention have been described in detail above, the invention is not limited to the specific embodiments mentioned above, and other combinations and configurations are also possible within the sprit and scope of the invention.

What is claimed is:

1. An antenna structure for a vehicle, comprising:

a first component member of a vehicle body of which at least a part is made of an insulating material;

a conductive film provided closer to an inside of the vehicle than the first component member; and a slot formed on a part of the conductive film to constitute an antenna wherein, the conductive film is provided across a space from the first component member.

2. The antenna structure for a vehicle according to claim 1, further comprising:

a second component member of the vehicle body of which at least a part is made of an insulating material, provided closer to the inside of the vehicle than the first component member, wherein the conductive film is attached onto the second component member.

3. The antenna structure for a vehicle according to claim 2, wherein the second component member is a roof liner.

4. The antenna structure for a vehicle according to claim 1, wherein a conductive portion of the vehicle body is provided in the space, and the conductive film is grounded on the conductive portion.

5. The antenna structure for a vehicle according to claim 4, wherein the conductive film is secured to the conductive portion of the vehicle body by at least one of a fastener and an adhesive.

6. The antenna structure for a vehicle according to claim 1, wherein the conductive film is integrated with an interior trim member inside a passenger compartment.

* * * * *